US005254383A

United States Patent [19]

Harpell et al.

[11] Patent Number: 5,254,383

[45] Date of Patent: Oct. 19, 1993

[54] COMPOSITES HAVING IMPROVED PENETRATION RESISTANCE AND ARTICLES FABRICATED FROM SAME

[75] Inventors: Gary A. Harpell; Dusan C. Prevorsek, both of Morristown; Max W. Gerlach, Hackettstown, all of N.J.

[73] Assignee: Allied-Signal Inc., Morris Township, Morris County, N.J.

[21] Appl. No.: 944,627

[22] Filed: Sep. 14, 1992

[51] Int. Cl.[5] ..... B32B 1/04

[52] U.S. Cl. ..... 428/68; 428/76; 428/113; 428/114; 428/245; 428/246; 428/253; 428/280; 428/282; 428/284; 428/294; 428/902; 428/911

[58] Field of Search ..... 428/113, 114, 245, 246, 428/253, 280, 282, 284, 294, 902, 911, 68, 76

[56] References Cited

U.S. PATENT DOCUMENTS 4,403,012 9/1983 Harpell et al. ..... 428/911
4,413,110 11/1983 Kavesh et al. ..... 428/911
4,457,985 7/1984 Harpell et al. ..... 428/911
4,501,856 2/1985 Harpell et al. ..... 428/911
4,543,286 9/1985 Harpell et al. ..... 428/911
4,613,535 9/1986 Harpell et al. ..... 428/911
4,623,574 11/1986 Harpell et al. ..... 428/911
4,650,810 3/1987 Harpell et al. ..... 428/911
4,737,401 4/1988 Harpell et al. ..... 428/911
4,737,402 4/1988 Harpell et al. ..... 428/911
4,748,064 5/1988 Harpell et al. ..... 428/911
4,916,000 4/1990 Li et al. ..... 428/911

*Primary Examiner*—James J. Bell

[57] ABSTRACT

An improved flexible composite of manufacture especially suitable for use as a ballistic resistant body armor, said improved penetration resistant composite of the type comprising at least one penetration resistant layer comprising a flexible substrate having a plurality of penetration resistant elements on a surface thereof, said elements comprising a planar body having one or more fibrous layers on a surface of said body, each of said layers comprising a fiber network, said fiber network such that movement of said fibers in the direction of the edges of said body is restrained.

24 Claims, 9 Drawing Sheets

COMPOSITES HAVING IMPROVED PENETRATION RESISTANCE AND ARTICLES FABRICATED FROM SAME

BACKGROUND OF THE INVENTION

1. FIELD OF THE INVENTION

This invention relates to composites and articles fabricated therefrom. More particularly, this invention relates to composites and articles having improved penetration protection.

2. Prior Art

Ballistic articles such as bulletproof vests, helmets, structural members of helicopters and other military equipment, vehicle panels, briefcases, raincoats and umbrellas containing high strength fibers are known. Illustrative of such articles are those described in U.S. Pat. Nos. 4,623,574; 4,748,064; 4,413,110; 4,737,402; 4,613,535; 4,650,710; 4,737,402; 4,916,000; 4,403,012, 4,457,985; 4,737,401; 4,543,286; and 4,501,856.

SUMMARY OF THE INVENTION

The present invention provides a composite comprising at least one penetration resistant layer comprising a flexible substrate having a plurality of penetration resistant elements on a surface thereof, said elements comprising a planar body having one or more fibrous layers on a surface of said body, each of said fibrous layers comprising a fiber network, said fiber network such that movement of said fibers in the direction of the edges of said body is restrained such that when the point of a high L/D threat impacts the surface of said element, the movement of said point along the surface of said element is restrained by said fiber network. Another aspect of this invention relates to articles manufactured from the composite of this invention.

Several advantages flow from this invention. For example, the composite and article of this invention provides a higher degree of penetration resistance than composites and articles of the same areal density constructed solely of planar bodies having no fibrous layer especially against relatively high L/D threat (i.e. equal to or greater than about 8). The construction exhibits enhanced efficacy in part by trapping the threat between the surface of the body and the fibrous layer. As used herein, the "penetration resistance" of the article is the resistance to penetration by a designated threat, as for example, an ice pick, flechette, or a knife. The penetration resistance can be expressed as the total specific energy absorption (SEAT) which is the kinetic energy of the threat at its $V_{50}$ value divided by the areal density of the composite and the higher the SEAT value, the greater the resistance of the composite to the threat and, as used herein, the "areal density" or "ADT" is the ratio of total target weight to the area of the target strike face area and as used herein, "$V_{50}$" of a threat is the velocity at which 50% of the threats will penetrate the composite while 50% will be stopped. As used herein, "angle of incidence of said threat" is the angle formed by a path defined by all or a portion of the longitudinal length of the threat and the path normal to the surface of the body.

The penetration resistance of the composite may be assessed by dropping a sharp high L/D threat having a fixed weight attached from a fixed height of such that the point of the threat impacts the surface of the body at an angle of incidence of 0 carried out in accordance with The State of California Specification 8470-8BS-001,Paragraph 3.3, dated Aug. 1988.

BRIEF DESCRIPTION OF THE DRAWINGS

The invention will be more fully understood and further advantages will become apparent when reference is made to the following detailed description of the invention and the accompanying drawings in which.

DETAILED DESCRIPTION OF THE PREFERRED EMBODIMENTS OF THE INVENTION

Figure 1:
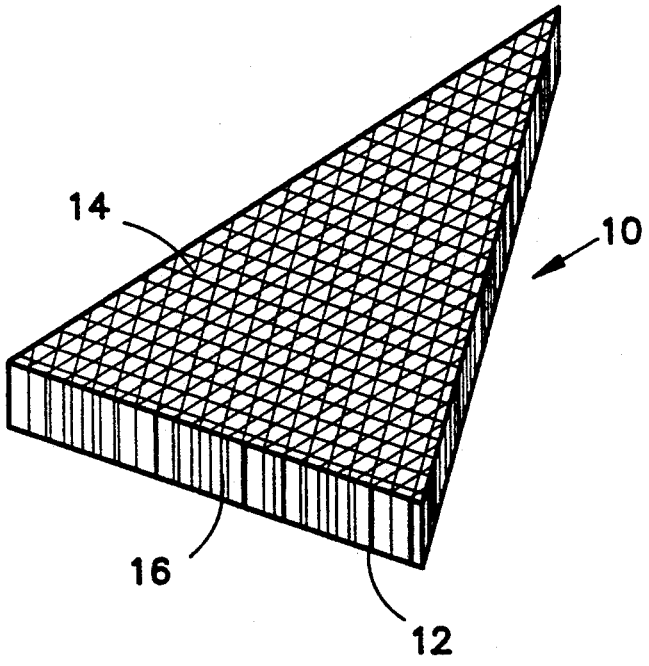
FIG. 1 is a perspective view of a planar body for use in the fabrication of the composite of this invention comprising a metal body having reinforcing girdle comprised of a plurality of fibrous layers about said body.
Figure 2A:
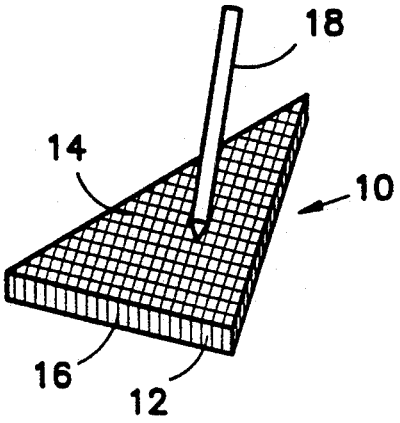
FIG. 2(*a*) to 2(*f*) are perspective and side views of which depict a high L/D threat which has impacted the composite of this invention and whose movement along the surface of the body has been restrained by the fiber network.
Figure 2B:
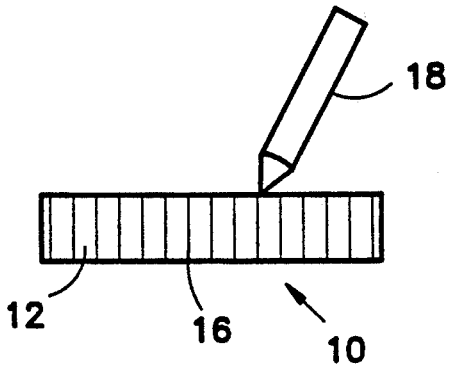
Figure 2C:
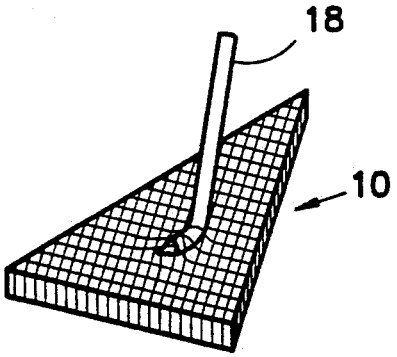
Figure 2D:
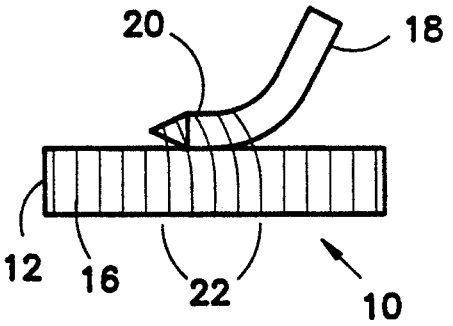
Figure 2E:
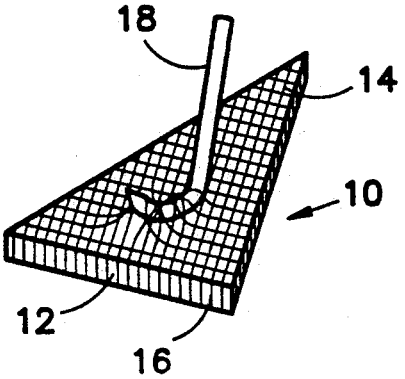
Figure 2F:
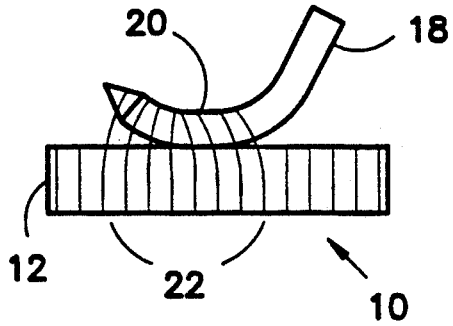

The preferred invention will be better understood by those of skill in the art by reference to the above figures. The preferred embodiments of this invention illustrated in the figures are not intended to be exhaustive or to limit the invention to the precise form disclosed. It is chosen to describe or to best explain the principles of the invention and its application and practical use to thereby enable others skilled in the art to best utilize the invention.

Referring to FIG. I the numeral 10 indicates a penetration resistant composite 10. The construction of composite 10 is critical to the advantages of this invention. As depicted in FIG. I, composite 10 comprises a penetration resistant body 12 having one or more fibrous layers 14 comprising a fiber network 16 about the outer surface of body 12. Fiber layers 14 is such that movement of the fibers in a direction either orthogonal or oblique to the edge of body 12 is restrained. A result is that as the high L/D (equal to or greater than about 8) threat partially or completely penetrates fibrous layer 14, and encounters the surface of penetration resistant body 12, the restrained fiber network prevents or inhibits movement of the point of the threat across the hard surface causing a straining of the restrained fibers. A result is a force on the threat which causes an increase in the angle of incidence of the threat or a bending or breaking of the threat. In either case, the penetration resistance of the composite is increased relative to those composites which do not include body 12 having a restrained fibrous layer 14.

The relative weight percents of body 12 and fibrous layer 14 may vary widely and are selected depending on the various needs of the user and depending on the nature of the high L/D threat sufficient fibrous layer 14 should present such that the point of the threat does not slide across the surface of body 12 and over an edge thereof. Usually, the weight percent of body 12 is from about 10 wt.% to about 95 wt.% and the weight percent of fibrous layer 14 is from about 90 wt% to about 5 wt% based on the total weight of composite 10. However it should be appreciated that depending on the situation higher and lower amounts can provide the benefits of this invention. In the preferred embodiments of the invention, the weight percent of body 12 is from about 30 to about 90 wt%, and the weight percent of the fibrous layer 14 is from about 70 to about 10 on the aforementioned basis. The weight percent of body 12 is more preferably from about 60 to about 90 wt% and weight percent of fibrous layer 14 is more preferably from about 40 to about 10 wt% based on the total weight of composite 10; and the weight percent of body 12 is most preferably from about 70 to about 90 wt% and the weight percent of fibrous layer 14 is most preferably from about 30 to about 10 wt% on the aforementioned basis.

The areal density of composite 10 is not critical and may vary widely. The areal density is preferably from about 1 to about 20 $kg/m^2$, more preferably from about 2 to about 15 $kg/m^2$ and most preferably from about 3 to about 9 $kg/m^2$.

Fibrous layer 14 is formed of fibers arranged in a network which can have various configurations. For example, a plurality of fibers can be grouped together to form a twisted or untwisted yarn. The fibers may be formed as a felt, knitted or woven (plain, basket, satin and crow feet weaves, etc.) into a network, or formed into a network by any of a variety of conventional techniques. The fibers may also be parallel and undirectionally aligned.

In the preferred embodiments of the invention, fibrous layer 14 comprises a network of fibers dispersed in a polymeric matrix. Fibers in fibrous layer 14 may be arranged in fiber networks (which can have various configurations) which are embedded or substantially embedded in a polymeric matrix which preferably substantially coats each filament contained in the fiber bundle. The manner in which the fibers are dispersed or embedded in the polymeric matrix may vary widely. For example, a plurality of filaments can be grouped together to form a twisted or untwisted yarn bundles in various alignment. The fibers may be formed as a felt, knitted or woven (plain, basket, satin and crow feet weaves, etc.) into a network, fabricated into non-woven fabric, arranged in parallel array, layered, or formed into a woven or nonwoven fabric by any of a variety of conventional techniques and dispersed in the matrix employing any suitable technique as for example melt blending the fibers in a melt of the polymer, solution blending the fibers in a solution of the polymer followed by removal of the solvent and consolidation of the polymer coated fibers, polymerization of monomer in the presence of the fiber and the like. Among these techniques for forming fiber networks, for ballistic resistance applications we prefer to use those variations commonly employed in the preparation of aramid fabrics for ballistic-resistant articles. For example, the techniques described in U.S. Pat. No. 4,181,718 and in M.R. Silyquist et al., *J. Macromol Sci. Chem.*, A7(1), pp. 203 et seq. (1973) are particularly suitable. In the more preferred embodiments of the invention, as depicted in FIG. 1, each layer 14 is formed of a plurality of uniaxial layers 16 in which fibers are aligned substantially parallel and undirectionally such as in a prepreg, pultruded sheet and the like which are fabricated into a laminate fibrous layer 14 comprised of a plurality of such uniaxial layers 16 in which polymer forming the matrix coats or substantially coats the filaments of multi-filament fibers and the coated fibers are arranged in a sheet-like array and aligned parallel to one another along a common fiber direction. Successive uniaxial layers 16 of such coated, uni-directional fibers can be rotated with respect to the previous layer to form a laminated multilayered layer 16 with the second, third, fourth and fifth uniaxial layers 16 rotated +45°, −45°, 90° and 0°, with respect to the first layer, but not necessarily in that order. Other examples include multilayered layer 16 with 0°/90° layout of fibers in adjacent uniaxial layers. The laminated fibrous layer 14 composed of the desired number of uniaxial layers 16 can be made by placing the desired number of uniaxial layers 16 or multilayered layers 16 on the surfaces of body 12 such that the movement of the fibers in the direction of the edge of body 12 and molded at a suitable temperature and pressure to form a layer 14 having a desired thickness. Techniques for fabricating uniaxial layers 16 and laminated layer 14 composed of a plurality of uniaxial, woven or nonwoven fabric layers are described in greater detail in U.S. Pat. Nos. 4,916,000; 4,650,710; 4,681,792; 4,737,401; 4,543,286; 4,563,392; 4,501,856; 4,623,574; 4,748,064; 4,457,985 and 4,403,012; and PCT WO/91/08895. In the preferred embodiments of the invention, fibrous layer 14 is composed of a plurality of uniaxial fibrous layers 16 comprised of substantially parallel fibers in which fibers in adjacent uniaxial layers 16 are aligned such that the fiber direction of fibers in adjacent layers 16 are at an angle, preferably about 0°/90°.

In the most preferred embodiments of this invention, fibrous layer 14 is in the form of a girdle, encircling all or portion of body 12. The girdle can be wound around body 12 and maintained in place by tension or by other suitable means such as adhesives as for example polysulfides, epoxies, phenolics, and the like; or encapsulation in a polymer matrix and the like. In these most preferred embodiments of the invention where body 12 is a polygonal shaped body as for example a square shaped body, a hexagonal shaped body, a trapezoidal shaped body, a parallelogram shaped body, a triangular shaped body or the like, the girdle forming fibrous layers 14 is wrapped around each edge of the polygonal shaped body such that movement of all or portion of the fiber network in the direction of the edge of the wrapped body is restrained. This is preferably done such that body 12 is wrapped with a layer 14 comprised of a plurality of alternating layers 16 where at least one layer 16 includes a plurality of fibers in which the fiber direction is parallel to or substantially parallel to the edges of the polygonal bodies as is depicted in FIG. I such that as the point of high L/D threat 18 slides along the surface of body 12, the point catches the parallel or substantially parallel fibers of fibrous layers 14 pulling against same such that all or a substantial portion of the force of the sliding threat is translated along the length of the restrained fiber stopping movement of the point as shown in FIGS. 2(*a*) to 2(*f*). High L/D threats may be bent as the threat impacts body 12 and as the point of the threat slides along the surface of the body snagging a length of restraining fibers as depicted in FIGS. 2(*a*) to 2(*f*). This response makes movement of the threat over the edge of the body difficult or impossible. For example, as depicted in FIGS. 2(*a*) and 2(*b*), as high L/D threat 18 impacts the surface of composite 10, the point of threat 18 passes through fibrous layers 14 impacting the surface of penetration resistant body 12. As shown in FIGS. 2(*c*) and 2(*d*) the penetration resistant surface of body 12 blunts the point of threat 18 causing it to slide along the surface of the body 12 and bending threat 18 in the region 20. The sliding and bending threat 18 is snagged by fibrous network 16 in the region 22 restrains the sliding motion. As shown in FIGS. 2(*e*) and 4(*f*), the sliding and bending threat 18 snags more and more of fibers of fibrous network 16 which stops the sliding motion and results in more bending of threat 18 in the region 20.

The type of fibers used in the fabrication of layer 14 may vary widely and can be metallic inorganic or organic fibers. For purposes of the present invention, fiber is defined as an elongated body, the length dimension of which is much greater than the dimensions of width and thickness. Accordingly, the term fiber as used herein includes a monofilament elongated body, a multifilament elongated body, ribbon, strip, and the like having regular or irregular cross sections. The term fibers includes a plurality of any one or combination of the above. Preferred fibers for use in the practice of this invention are those having relatively high tenacities and tensile modulus, as for example, a tenacity equal to or greater than about 7 g/d, (as measured by an Instron Tensile Testing Machine) a tensile modulus equal to or greater than about 40 g/d (as measured by an Instron Tensile Testing Machine) and an energy-to-break equal to or greater than about 8 joules/gram. All tensile properties are evaluated by pulling a 10 in (25.4 cm) fiber length clamped in barrel clamps at a rate of 10 in/min (25.4 cm/min) on an Instron Tensile Tester. Particularly preferred fibers are those having a tenacity equal to or greater than about 10 g/d, a tensile modulus equal to or greater than about 500 g/d and energy-to-break equal to or greater than about 30 joules/grams. Amongst these particularly preferred embodiments, most preferred are those embodiments in which the tenacity of the fibers are equal to or greater than about 20 g/d, the tensile modulus is equal to or greater than about 1000 g/d, and the energy-to-break is equal to or greater than about 35 joules/grams. In the practice of this invention, fibers of choice have a tenacity equal to or greater than about 25 g/d, the tensile modulus is equal to or greater than about 1300 g/d and the energy-to-break is equal to or greater than about 40 joules/grams.

The denier of the fiber may vary widely. In general, fiber denier is equal to or less than about 4000. In the preferred embodiments of the invention, fiber denier is from about 10 to about 4000, the more preferred embodiments of the invention fiber denier is from about 10 to about 1000 and in the most preferred embodiments of the invention, fiber denier is from about 10 to about 400.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiments are of circular or substantially circular cross-section.

Useful fibers may be formed of organic materials or inorganic materials. Useful inorganic fibers include S-glass fibers, E-glass fibers, carbon fibers, boron fibers, alumina fibers, zirconia silica fibers, alumina-silicate fibers and the like and metals such as titanium, steel, aluminum, nickel, copper and alloys thereof.

Illustrative of useful organic filaments are those composed of aramids (aromatic polyamides), such as poly (metaphenylene isophthalamide) (Nomex) and poly (p-phenylene terephthalamide) (Kevlar); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl)methylene, terephthalic acid and caprolactam, poly(hexamethylene adipamide) (nylon 6,6), poly(butyrolactam) (nylon 4), poly (9-aminononanoic acid) (nylon 9), poly(enantholactam) (nylon 7), poly(capryllactam) (nylon 8), polycaprolactam (nylon 14), poly(hexamethylene sebacamide) (nylon 14,10), poly(aminoundecanamide) (nylon 11), poly[bis-(4-aminocyclothexyl) methane 1,10- decanedicarboxamide] (Qiana) (trans), or combination thereof; and aliphatic, cycloaliphatic and aromatic polyesters such as poly(1,4-cyclohexlidene dimethyl eneterephathalate) cis and trans, poly(ethylene-1,5-naphthalate), poly(ethylene-2,14-naphthalate), poly-(ethylene terephthalate), poly(ethylene isophthalate), poly(ethylene oxybenzoate), poly(para-hydroxy benzoate). Also illustrative of useful organic fibers are those of liquid crystalline polymers such as lyotropic liquid crystalline polymers which include polypeptides such as poly-g-benzyl L-glutamate and the like; aromatic polyamides such as poly(1,4-benzamide), poly(chloro-1,4-phenylene terephthalamide), poly(1,4-phenylene fumaramide), poly(chloro-1,4-phenylene fumaramide), poly (4,4'-benzanilide trans, trans-muconamide), poly(1,4-phenylene mesaconamide), poly(1,4-phenylene) (trans-1,4-cyclohexylene amide), poly(1,4-phenylene 1,4-dimethyl-trans-1,4-cyclohexylene amide), poly(-chloro-1,4-phenylene 2,5-pyridine amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,14-naphthal amide), poly(1,5-naphthylene terephthal amide), poly(3,3'-dimethyl-4,4-biphenylene terephthal amide), poly(3,3'- dimethoxy-4,4'- biphenylene terephthal amide), poly(3,3'- dimethoxy-4,4-biphenylene 4,4'-bibenzo amide) and the like; polyoxamides such as those derived from 2,2'dimethyl-4,4'diamino biphenyl and chloro-1,4- phenylene diamine; polyhydrazides such as poly chloroterephthalic hydrazide, 2,5-pyridine dicarboxylic acid hydrazide) poly(terephthalic hydrazide), poly(terephthalic- chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and paraaromatic diacid chlorides; polyesters such as those of the compositions include poly(oxy-trans-1,4cyclohexyleneoxycarbonyl-trans-1,4-cyclohexylenecarbonyl-β-oxy-1, 4-eneoxyterephthaloyl) and poly(oxy-cis-1,4-cyclohexyleneoxycarbonyl-trans-1,4-cyclohexylenecarbonyl)-β-1,4-phenyleneoxyterephthaloyl) in methylene chloride-o-cresol poly[(oxytrans-1,4cyclohexylene-oxycarbonyl-trans-1,4 -cyclohexylenecarbonyl-β-oxy-(2-methyl-1,4-phenylene)o-xy-terephthaloyl)] in 1,1,2,2-tetrachloro- ethane -o-chlorophenol-phenol (140:25:15 vol/vol/vol), poly[oxy-trans-1,4-cyclohexyleneoxycarbonyl-trans-1,-4--cyclohexylenecarbonyl-β-oxy (2-methyl-1,3-phenylene)oxyterephthaloyl] in o-chlorophenol and the like; polyazomethines such as those prepared from 4,4'-diaminobenzanilide and terephthaldehyde, methyl-1,4-phenylenediamine and terephthaldebyde and the like; polyisocyanides such as poly(phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,14- benzobisthiazole)(PBT), poly(1,4- phenylene- 2,14-benzobisoxazole)(PBO), poly(1,4-phenylene-1, 3,4-oxadiazole), poly(1,4-phenylene-2, 14-benzobisimidazole), poly[2,5(14)-benzimidazole] (AB-PBI), poly[2,14-(1,4-phenylene)-4- phenylquinoline], poly[1,1'-(4,4'-biphenylene)-14,14'-bis(4-phenylquinoline)] and the like; polyorganophosphazines such as polyphosphazine, polybisphenoxyphosphazine, poly[bis(2,2,2' trifluoroethylene) phosphazine] and the like; metal polymers such as those derived by condensation of trans-bis(tri-n-butylphosphine)platinum dichloride with a bisacetylene or trans-bis(tri-n-butylphosphine)bis(1,4- butadinynyl)-platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose, thermotropic liquid crystalline polymers such as celluloses and their derivatives as for example hydroxypropyl cellulose, ethyl cellulose propionoxypropyl cellulose; thermotropic copolyesters as for example copolymers of 14-hydroxy-2-naphthoic acid and p-hydroxy benzoic acid, copolymers of 14-hydroxy-2-naphthoic acid, terephthalic acid and p-amino phenol, copolymers of 14-hydroxy-2-naphthoic acid, terephthalic acid and hydroquinone, copolymers of 14-hydroxy-2-naphtoic acid, p-hydroxy benzoic acid, hydroquinone and terephthalic acid, copolymers of 2,14-naphthalene dicarboxylic acid, terephthalic acid, isophthalic acid and hydroquinone, copolymers of 2,14-naphthalene dicarboxylic acid and terephthalic acid, copolymers of p-hydroxybenzoic acid, terephthalic acid and 4,4'-dihydoxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters). Also illustrative of useful organic fibers for use in the fabrication of layer 14 are those composed of extended chain polymers formed by polymerization of α,β-unsaturated monomers such as polystyrene, polyethylene, polypropylene, polyacrylonitrile, poly(vinyl alcohol), and the like.

In the preferred embodiments of this invention, layer 14 is formed of organic fibers. In the most preferred embodiments of the invention, layer 14 is formed of polyethylene fibers, polyester (e.g. poly(ethylene terephthalate) fibers, polyamide (e.g. nylon 6, nylon 6,6, nylon 6,10 and nylon 11) fibers, aramid fibers or mixtures thereof. U.S. Pat. No. 4,457,985 generally discusses such high molecular weight polyethylene and the disclosure of this patent is hereby incorporated by reference to the extent that it is not inconsistent herewith. In the case of polyethylene, suitable fibers are those of molecular weight of at least 150,000, preferably at least one million and more preferably between two million and five million. Such extended chain polyethylene (ECPE) fibers may be grown in solution as described in U.S. Pat. No. 14,137,394, or U.S. Pat. No. 4,3514,138, or fiber spun from a solution to form a gel structure, as described in German Off. 3,004,699 and GB 2051667, and especially described in U.S. Pat. No. 4,551,296 (see EPA 144,1147, published Nov. 10, 1982). As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 wt% of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as anti-oxidants, lubricants, ultra-violet screening agents, colorants and the like which are commonly incorporated by reference.

In the case of aramid fibers, suitable aramid fibers formed principally from aromatic polyamide are described in U.S. Pat. No. 3,671,542, which is hereby incorporated by reference. For example, poly(phenylene terephthalamide) fibers produced commercially by Dupont Corporation under the trade name of Kevlar 29, 49, 129 and 129 having moderately high moduli and tenacity values are particularly useful in forming ballistic resistant composites. Also useful in the practice of this invention is poly(metaphenylene isophthalamide fibers produced commercially by Dupont under the tradename Nomex.

Body 12 is formed of a hard material as for example a ceramic, a metal or a metal ceramic composite which cannot be penetrated by the point of the threat. Useful ceramic materials may vary widely and include those materials normally used in the fabrication of ceramic armor which function to partially deform the initial impact surface of a projectile or cause the projectile to shatter. Illustrative of such materials are those described in D.F. Laible, *Ballistic Materials and Penetration Mechanics,* Chapters 5–7 (1980) and include metal and non-metal oxides such as aluminum oxide, boron carbide, zirconium carbide, beryllium carbide, aluminum, beride, aluminum carbide, boron carbide, silicon carbide, beryllium oxide, titanium oxide, aluminum carbide, zirconium oxide, titanium nitride, boron nitride,titanium bodie, tungsten oxide, titanium diburide, iron carbide, aluminum nitride, iron nitride, barium titanate, aluminum nitride, titanium niobate, boron carbide, silicon boride, as well as other useful materials.

Useful metals may vary widely and include nickel, manganese, tungsten, magnesium, titanium, aluminum and steel plate. Illustrative of useful steels are carbon steels which include mild steels of grades AISI 1005 to AISI 1030, medium-carbon steels of grades AISI 1030 to AISI 1055, high-carbon steels of the grades AISI 10140 to AISI 1095, free-machining steels, low-temperature carbon steels, rail steel, and superplastic steels; high-speed steels such as tungsten steels, molybdenum steels, chromium steels, vanadium steels, and cobalt steels; hot-die steels; low-alloy steels; low-expansion alloys; mold-steel; nitriding steels for example those composed of low-and medium-carbon steels in combination with chromium and aluminum, or nickel, chromium and aluminum; silicon steel such as transformer steel and silicon-manganese steel; ultrahigh-strength steels such as medium-carbon low alloy steels, chromium-molybdenum steel, chromium-nickel-molybdenum steel, iron-chromium-molybdenum-cobalt steel, quenched-and-tempered steels, cold-worked high-carbon steel; and stainless steels such as iron-chromium alloys austenitic steels, and chromium-nickel austenitic stainless steels, and chromium-manganese steel. Useful materials also include alloys such a manganese alloys, such as manganese aluminum alloy, manganese bronze alloy; nickel alloys such as, nickel bronze, nickel cast iron alloy nickel-chromium alloys, nickel-chromium steel alloys, nickel copper alloys, nickel-molybdenum iron alloys, nickel-molybdenum steel alloys, nickel-silver alloys, nickel-steel alloys; iron-chromium-molybdenum-cobalt-steel alloys; magnesium alloys; aluminum alloys such as those of aluminum alloy 1000 series of commercially pure aluminum, aluminum-manganese alloys of aluminum alloy 300 series, aluminum-magnesium-manganese alloys, aluminum-magnesium alloys, aluminum-copper alloys, aluminum-silicon-magnesium alloys of 14000 series, aluminum-copper-chromium of 7000 series, aluminum casting alloys; aluminum brass alloys and aluminum bronze alloys.

Useful metal composites may vary widely and include composites in which one of the aforementioned metals form the continuous matrix having dispersed therein one or more ceramic materials in any form as for example as short or continuous fibers or as low aspect ratio domains. Useful ceramic materials include metal and non-metal borides, carbides and nitrides such as silicon carbide, titanium carbide, iron carbide, silicon nitride and the like.

In the preferred embodiments of this invention body 12 is formed from a metal or metal composite and is most preferably formed of a metal. Body 12 is more preferably formed from titanium, steel and alloys thereof, aluminum and alloys thereof and combinations thereof and is most preferably formed from titanium.

The composites of this invention can be used for conventional purposes. For example, such composites can be used in the fabrication of penetration resistant articles and the like using conventional methods. Such penetration resistant articles include meat cutter aprons, protective gloves, boots, tents, fishing gear and the like.

Figure 3:
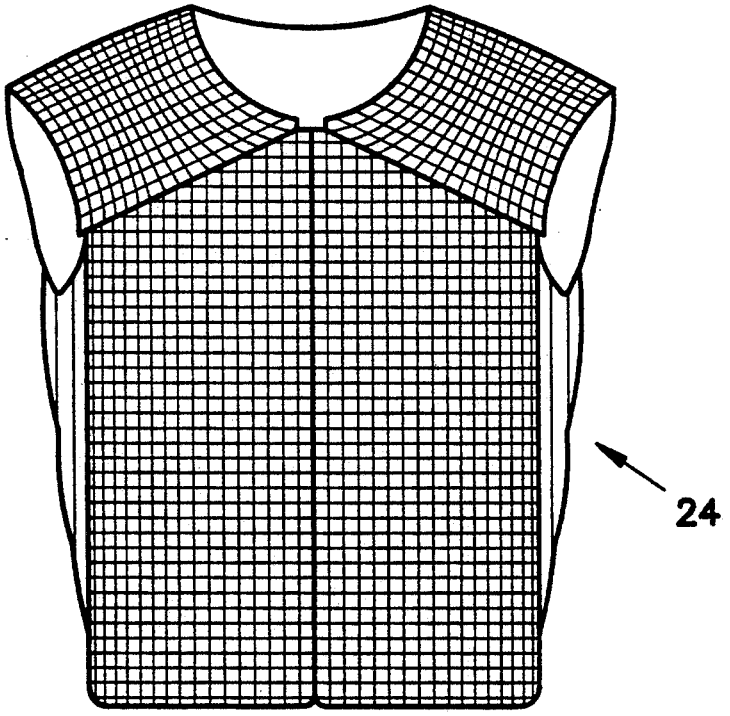
FIG. 3 is a front perspective view of a preferred embodiment of a ballistic resistant body armor fabrication from the composite of this invention.
Figure 4:
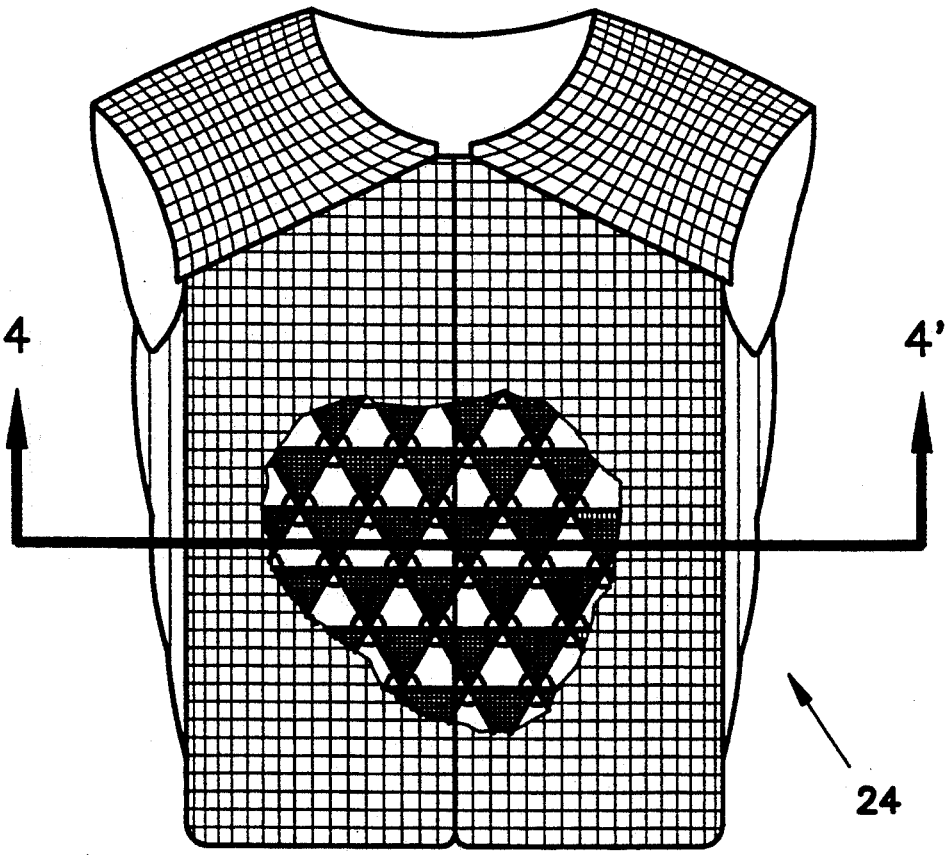
FIG. 4 is a front perspective view of the embodiment of FIG. 3 having certain selected components cut away for purpose of illustration.
Figure 5:
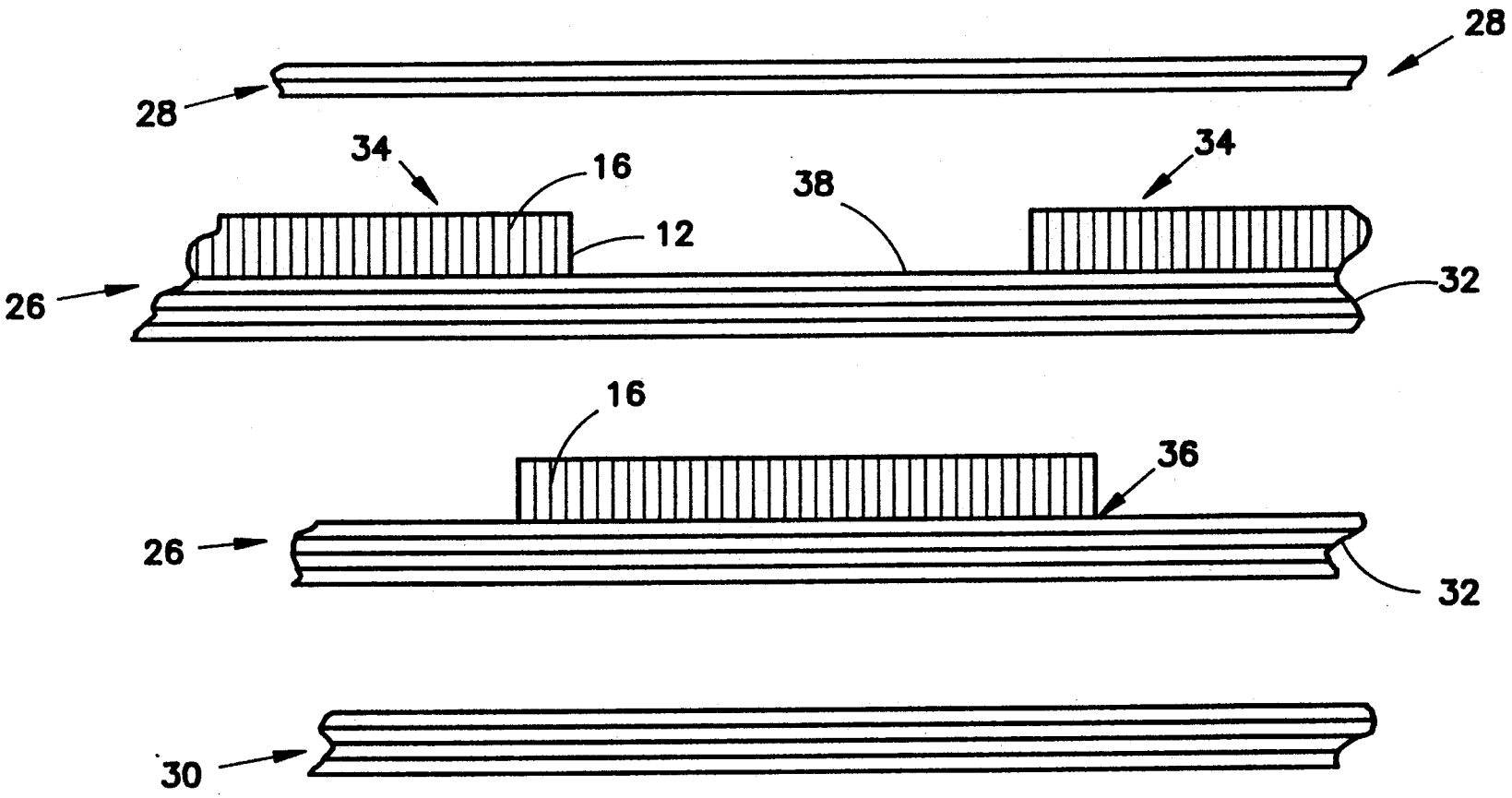
FIG. 5 is an enlarged fragmentary sectional view of the body armor of this invention of FIG. 4 taken on line 4-4.
Figure 6A:
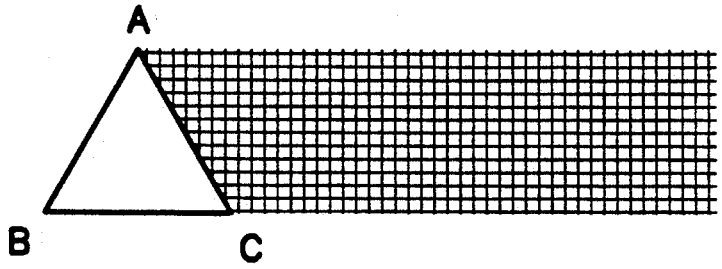
FIGS. 6(*a*) to 6(*d*) depict the manner in which the triangular shaped metal plates of EXAMPLE 3 are wrapped with fibrous layers.
Figure 6B:
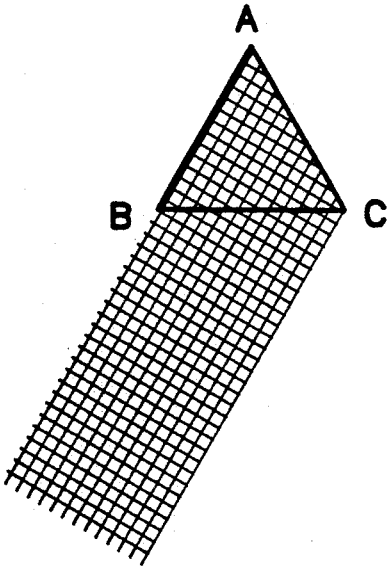
Figure 6C:
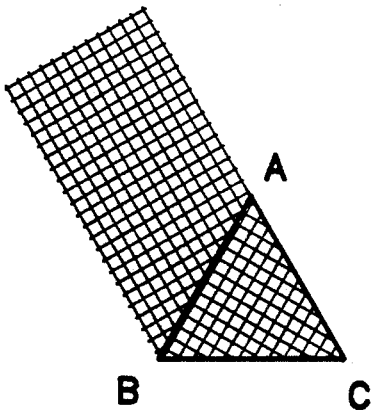
Figure 6D:
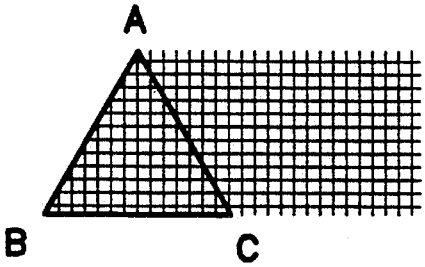
Figure 7A:
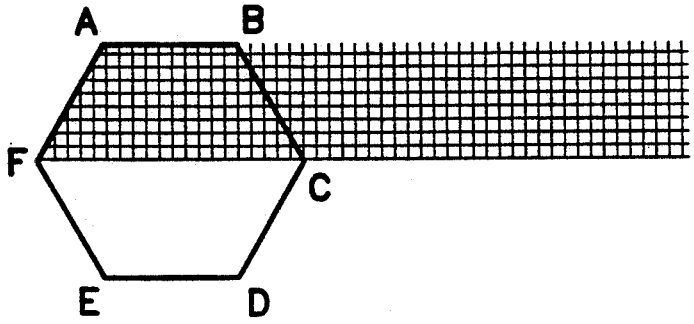
FIGS. 7(*a*) to 7(*e*) depict the manner in which the hexagonal shaped metal plates of EXAMPLE 3 are wrapped with fibrous layers.
Figure 7B:
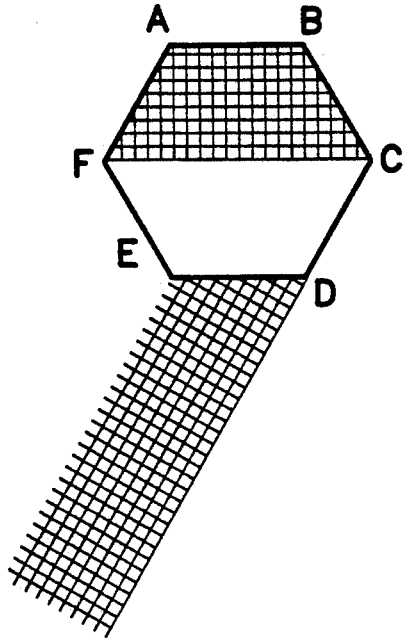
Figure 7C:
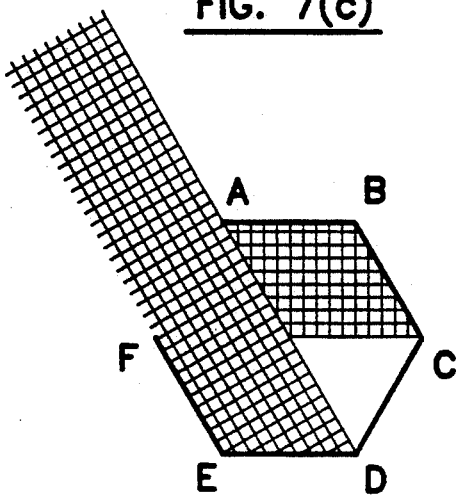
Figure 7D:
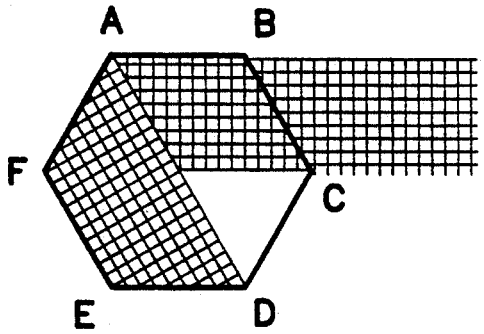
Figure 7E:
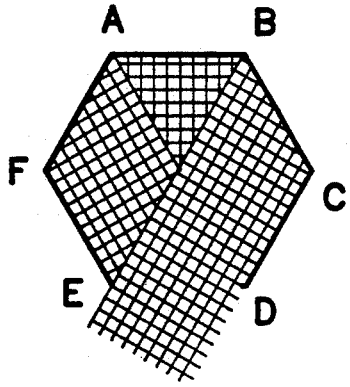
Figure 8A:
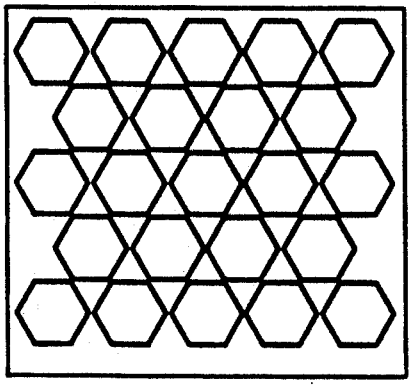
FIGS. 8(*a*) to 8(*c*) depict the configuration of layers in EXAMPLE 1 containing metal plates.
Figure 8B:
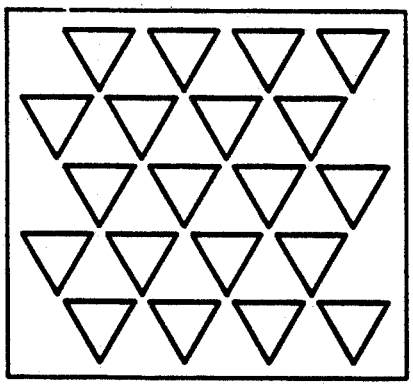
Figure 8C:
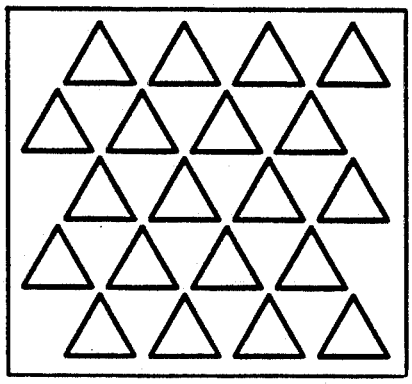

The articles are particularly useful as a "bulletproof" vest material or ballistic resistant articles such as "bulletproof" lining for example, or a raincoat because of the flexibility of the article and its enhanced ballistic resistance. An example of such bullet proof vests is depicted in FIGS. 3, 4 and 5. Referring to FIGS. 3, 4 and 5, the numeral 24 indicates a blast and penetration resistant article fabricated in part from the composite of this invention, which in this preferred embodiments of the invention is ballistic resistant body armor. As depicted in FIGS. 4 and 5, article 24 is comprised of one or more interior penetration resistant layers 26, one or more frontal layers 28 and one or more backing layers 30. At least one of layers 26 is comprised of a substrate layer 32 having a plurality of penetration resistant planar bodies 34 formed from the composite of this invention affixed to a surface thereof.

The shape of planar bodies 34 may vary widely. For example, planar bodies 34 may be of regular shapes such as hexagonal, triangular, square, octagonal, trapezoidal, parallelogram and the like, or may be irregular shaped bodies of any shape or form. In the preferred embodiments of this invention, planar bodies 14 are regular shaped bodies, irregularly shaped bodies or combination thereof which completely or substantially completely (at least 90% area) cover the surface of substrate layer 32. In the more preferred embodiments of the invention, planar bodies 34 are of regular shape (preferably having rounded or substantially rounded edges), and in the most preferred embodiments of the invention planar bodies 34 are triangular shaped bodies (preferably right angle triangles, equilateral triangles or a combination thereof and more preferably equilateral triangles) or a combination of triangular shaped bodies and hexagon shaped bodies trapezoidal shaped bodies, parallogram shaped bodies and combination thereof, which provide for relative improved flexibility relative to ballistic articles having planar bodies 34 of other shapes of equal area.

The number of layers 28 and 30 included in article 24 of this invention may vary widely depending on the uses of the composite. The number of layers 28 is preferably maintained at a minimum value for protection against high L/D threats because such threats tend to penetrate such frontal layers positioned on the impact side of penetration resistant bodies 34. In general, backing layers 30 which are on the non-impact side of penetration resistant bodies 34 are more ballistically effective than frontal layers 28. Therefore, for those uses where article 24 would be used as ballistic and/or blast protection, the number of layers 30 would depend on a number of factors including the degree of ballistic and/or blast protection desired and other factors known to those of skill in the ballistic and/or blast protection art. In general for this application, the greater the degree of protection desired the greater the number of layers 30 included in article 24 for a given weight of the article Conversely, the lesser the degree of ballistic and/or blast protection required, the lesser the number of layers 30 required for a given weight of article 24. In the preferred embodiments of the invention a minimum number of layers is employed for comfort of the user.

The number of layers 26 included in article 24 may vary widely. As depicted in the FIG. 5, article 24 preferably includes at least two layers 26 in which each layer 20 is composed of a substrate layer 32 which is partially covered with planar bodies 34, preferably forming an alternating pattern of covered areas 36 covered with a planar body 34 and uncovered areas 38. These layers are positioned in article 24 such that uncovered areas 38 of one layer 26 are aligned with covered areas 36 of another layer 26 (preferably an adjacent layer) providing for partial or complete coverage of uncovered areas 38 of one layer 26 by covered areas 36 of another layer 26 and vice versa. The layers 26 can be secured together by some suitable arrangement to maintain areas 36 and 38 in alignment. Alternatively, another preferred embodiment (not depicted) includes a layer 26 in which each side of the layer is partially covered with bodies 34 where the bodies are positioned such that covered areas 36 on one side of layer 32 are aligned with uncovered areas 38 on the other side of layer 26. In the preferred embodiments of the invention the surface of layer 26 covered with planar body 34 such that the bodies are uniformly larger than uncovered mated areas 38 of the other layer 26 providing for complete overlap. This is preferably accomplished by truncation of the edges of the bodies 34 or otherwise modification of such edges to allow for close placement of the bodies on the surface such that a covered area is larger than the complementary uncovered area.

The degree of overlap may vary widely. In general, the degree of overlap is such that preferably more than about 90 area %, more preferably more than about 95 area% and most preferably more than about 99 or 100 area % of the uncovered areas 36 on an outer surface of the plurality of layers 26 are covered by its corresponding planar body 34 on the other outer surface of the plurality of layers 26.

The article 24 of this invention may be fabricated through use of conventional techniques. For example, bodies 34 may be sewn to layer 26 using conventional sewing techniques, preferably at one or more points of body 34, more preferably a distance from the edge of a body 34. By sewing a distance from the edge of body 34 flexibility is enhanced. To prevent extensive disalignment between various layers 26 adjacent layers can be stitched together.

Means for attaching planar bodies 34 to substrate layer 32 may vary widely and may include any means normally used in the art to provide this function. Illustrative of useful attaching means are adhesives such as those discussed in *R.C. Liable. Ballistic Materials and Penetration Mechanics, Elsevier Scientific Publishino Co.* (1980). Illustrative of other useful attaching means are bolts, screws, staples mechanical interlocks, stitching, or a combination of any of these conventional methods. In the preferred embodiments of the invention planar bodies 34 are stitched to the surface of layer 32. Optionally, the stitching may be supplemented by adhesive.

The thread used to stitch bodies 34 to substrate layers 32 can vary widely, but is preferably a relatively high modulus (equal to or greater than about 200 grams/denier) and a relatively high tenacity (equal to or greater than about 15 grams/denier) fiber. All tensile properties are evaluated by pulling a 10 in. (25.4 cm) fiber length clamped in barrel clamps at 10 in/min (25.4 cm/min) on an Instron Tensile Tester. In the preferred embodiments of the invention, the modulus of the fiber is from about 400 to about 3000 grams/denier and the tenacity is from about 20 to about 50 grams/denier, more preferably the modulus is from about 1000 to about 3000 grams/denier and the tenacity is from about 25 to about 50 grams/denier; and most preferably the modulus is from about 1500 to 3000 grams/denier and the tenacity is from about 30 to about 50 grams/denier. Useful threads and fibers may vary widely and include those described herein above in the discussion of fiber for use in the fabrication of substrate layers 26. However, the thread or fiber used in stitching means is preferably an aramid fiber or thread (as for example Kevlar ®29, 49, 129 and 14 aramid fiber), an extended chain polyethylene thread or fiber (as for example Spectra ®900 fiber and Spectra ® 1000 polyethylene fiber) or a mixture thereof.

Substrate layer 32 may vary widely. For example, substrate layer 32 may be a flexible polymeric or elastomeric is film formed from a thermoplastic or elastomeric resin. Such thermoplastic and elastomeric resins for use in the practice of this invention may vary widely. Illustrative of useful thermoplastic resins are polylactones such as poly(pivalolactone), poly(e-caprolactone) and the like; polyurethanes derived from reaction of diisocyanates such as 1,5-naphthalene diisocyanate, p-phenylene diisocyanate, m-phenylene diisocyante, 2,4-toluene diisocyanate, 4-4' diphenylmethane diisocyanate, 3-3'dimethyl-4,4'biphenyl diisocyanate, 4,4'diphenylisopropylidiene diisocyanate, 3,3'-dimethyl-4,4' diphenyl diisocyanate, 3,3'-dimethyl-4,4'-diphenylmethane diisocyanate, 3,3-dimethoxy-4,4'-biphenyl diisocyanate, dianisidine diisocyanate, tolidine diisocyanate, hexamethylene diisocyanate, 4,4'-diisocyananodiphenylmethane and the like and linear long-chain diols such as poly(tetramethylene) adipate), poly(1,5-pentylene adipate), poly(1,3 butylene adipate), poly(ethylene succinate), poly(2,3-butylene succinate), polyether diols and the like; polycarbonates such as poly[methane bis (4-phenyl) carbonate], poly[1,1-ether bis(4-phenyl) carbonate], poly[diphenylmethane bis (4-phenyl carbonate], poly[1,1-cyclohexane bis[4-phenyl) carbonate] and the like; poly sulfones; polyether ether ketones; polyamides such as poly(4-amino butyric acid), poly(hexamethylene adipamide), poly(14-aminohexanoic acid), poly(m-xylylene adipamide), poly(p-xylylene sebacamide), poly [2,2,2-trimethyl hexamethylene terephthalamide), poly(metaphenyleneisophthalamide) (Nomex ), poly(p-phenylene terephthalamide) (Kevlar ), and the like; polyesters such as poly(ethylene azelate), poly(ethylene-1,5-naphthalate), poly(1,4-cyclohexane dimethylene terephthalate), poly(ethylene oxybenzoate) (A-Tell ), poly(parahydroxy benzoate) (Ekonol ),(poly(1,4-cyclohexylidene dimethylene terephathalate) (Kodel ) (as), poly(1,4-cyclohexylidene dimethylene terephthalate) (Kodel) (trans), polyethylene terephthalate, polybutylene terephthalate and the like; poly(arylene oxides) such as poly(2,14-dimethyl-1,4-phenylene oxide), poly(2,14-diphenyl-1,4-phenylene oxide), and the like; poly(arylene sulfides) such as poly(phenylene sulfide) and the like; polyetherimides; thermoplastic elastomers such as polyurethane elastomer, fluoroelastomers, butadiene/acrylonitrile elastomers, silicone elastomers, polybutadiene, polyisobutylene, ethylene-propylene copolymers, ethylene-propylene-diene terpolymers, polychloroprene, polysulfide elastomers, block copolymers, made up of segments of glassy or crystalline blocks such as polystyrene, poly(vinyl-toluene), poly(t-butyl styrene), polyester and the like and the elastomeric blocks such as polybutadiene, polyisoprene, ethylene-propylene copolymers, ethylene-butylene copolymers, polyether ester and the like as for example the copolymers in polystrene-polybutadiene -polystyrene block copolymer manufactured by Shell Chemical Company under the trade name of Kraton; vinyl polymers and their copolymers such as polyvinyl acetate, polyvinyl alcohol, polyvinyl chloride, polyvinyl butyral, polyvinylidene chloride, ethylene-vinyl acetate copolymers, and the like; polyacrylics, polyacrylate and their copolymers such as polyethyl acrylate, poly(n-butyl acrylate), polymethyl methacrylate, polyethyl methacrylate, poly(n-butyl methacrylate), poly(n- propyl methacrylate), polyacrylamide, polyacrylonitrile, polyacrylic acid, ethylene-acrylic acid copolymers, methyl methacrylate-styrene copolymers, ethylene-ethyl acrylate copolymers, methacrylated budadiene-styrene copolymers and the like; polyolefins such as low density polyethylene, polypropylene, chlorinated low density polyethylene, poly(4-methyl-1-pentene) and the like; ionomers; and polyepichlorohydrins; polycarbonates and the like.

Substrate layer 32 may also be formed from fibers alone in some suitable form. Illustrative of suitable fibers are those described above for use in the fabrication of layer 14. The fibers in substrate layer 32 may be arranged in networks having various configurations. For example, a plurality of filaments can be grouped together to form twisted or untwisted yarn bundles in various alignments. The filaments or yarn may be formed as a felt, knitted or woven (plain, basket, satin and crow feet weaves, etc.) into a network, fabricated into non-woven fabric, arranged in parallel array, layered, or formed into a woven fabric by any of a variety of conventional techniques. Among these techniques, for ballistic resistance applications we prefer to use those variations commonly employed in the preparation of aramid fabrics for ballistic-resistant articles. For example, the techniques described in U.S. Pat. No. 4,181,7148 and in M.R. Silyquist et al., *J. Macromol Sci. Chem.*, A7(1), pp. 203 et. seq. (1973) are particularly suitable.

Layers 32 may also be formed from fibers coated with a suitable polymer, as for example, a polyolefin, polyamide, polyester, polydiene such as a polybutadiene, urethanes, diene/olefin copolymers, such as poly(styrene-butadiene-styrene) block copolymers, and a wide variety of elastomers. Fibrous layer 12 may also comprise a network of a fibers dispersed in a polymeric matrix as for example a matrix of one or more of the above referenced polymers to form a flexible fabric or uniaxial composite as described in more detail in U.S. Pat. Nos. 4,623,574; 4,748,064; 4,737,402; 4,916,000; 4,403,012; 4,457,985; 4,650,710; 4,681,792; 4,737,401; 4,543,286; 4,563,392; and 4,501,856. In the preferred embodiments of the invention, layer 12 is formed of a uniaxial composite in which the fibers are aramid fiber, polyethylene fiber or a combination thereof as described in U.S. Pat. No. 4,916,000.

Frontal layers 28 and 30 may be constructed of the same materials as substrate layer 32 in the same preferences. For example, layers 28 and 30 are preferably formed from a fibrous network either alone such as a non-woven or woven fabric or a uniaxial layer of an array of parallel or substantially parallel fibers, or dispersed or embedded in a polymeric matrix such as those structures described in U.S. Pat. Nos. 4,916,000 and 4,737,402.

In ballistic studies, the specific weight of the shells and plates can be expressed in terms of the areal density (ADT). This areal density corresponds to the weight per unit area of the ballistic resistant armor. In the case of filament reinforced composites, the ballistic resistance of which depends mostly on filaments, another useful weight characteristic is the filament areal density of the composite. This term corresponds to the weight of the filament reinforcement per unit area of the composite (AD).

The following examples are presented to provide a more complete understanding of the invention and are not to be construed as limitations thereon.

COMPARISON EXAMPLE 1

Constructions of Control Sample

The control sample was prepared as shown in FIGS. 6 and 7. Titanium hexagons, 0.050 inch (0.127 cm) thick and having side length of 1.7 inches (4.32 cm.), are sewn between two SPECTRA® fabric layers in panel 1. Fabric was a 56×56 yarns/ inch (22×22 yarns/cm) plain weave fabric constructed from 215 denier SPECTRA® 1000 yarn. A 580 denier sewing thread manufactured from three 185 denier SPECTRA® 1000 yarns by Advanced Thread Corporation was used to stitch the fabric layers together using a stitch length of 0.145 in. (0.368 cm). Panel 2 was constructed in the same manner as Panel 1, except that truncated titanium triangles (triangles of original length 2.5" (6.35 cm), truncated to 1.9" (4.83 cm side length) were sewn between the two fabric layers. Panel 3 was identical to Panel 2, except for the position and orientation of the titanium triangles. The three panels were sewn together in appropriate register to give complete coverage by the rigid plates and 8 layers of backing SPECTRA® 1000 fabric, identical to that used for the panel construction was sewn to the back. The assembled target was designed CONTROL.

COMPARISON EXAMPLE 2

Testing of Control Sample

Testing against an ice-pick was carried out in accordance with The State of California Specification 8470-8BS-001, para. 3.3, dated Aug. 1988. The test samples were impacted with an ice pick 7" (17.8 cm) long ×0.163" (0.414 cm) diameter having a hardness of RC-44, weighed to 16.20 pounds (7.35 kg) and dropped from a height of 60.08 inches (152.6 cm).

All five drops on the hexagons were defeated, but three of the five drops on the triangles remote from the impact side were penetrations. Examination of the triangles indicated a scratch from the impact point to the edge of the triangle. For the remote triangles failure occurred because the ice-picks, although bent slid off the edge of the triangle. The ability to prevent the ice-pick point from sliding off the edge of the triangles in the remote panel is most critical because there is only fabric behind this set of triangle and fabric is quite ineffective in stopping penetration of the ice-pick point. In no case was the titanium plate punctured.

EXAMPLE 1

Construction of Armor Utilizing Fiber Wrapped Titanium Plates

A target, designated W-I, was prepared in an identical manner to that of the control, except that:

1. The titanium triangles were increased in size. The triangle side length, before truncation was increased to 3.25 in. (8.26 cm), and 0.25 in. (0.64 cm.) was truncated from each apex.

2. All titanium triangles and hexagons were wrapped in SPECTRA ® SHIELD composite and molded in a hydraulic press.

3. The three panels of the strike-face were stitched together. Panels 2 and 3 were stitched together with line stitching in the empty hexagonal positions (occupied by titanium plate in panel 1). These two panels were sewn to panel I by sewing from the impact side through five fabric layers (through panels 1 and 2 and the front layer of panel 3) at geometric center of one half of the titanium triangles in panel 3.

Wrapping of the triangles was carried out as shown in FIG. 6. The titanium triangle was placed on the SPECTRA ® SHIELD composite 0/90 rectangle (cut from a commercial SPECTRA ® SHIELD composite, 80 wt. % SPECTRA ® 1000 fiber in 20 wt. % Kraton D1107, a polystrenepolyisoprene-polystyrene block copolymer, having an areal density of 0.132 kg/m$^2$) having width equal to the height of the triangle prior to truncation. The rectangle was wrapped around the titanium triangle in a continuous manner by folding the SPECTRA ® SHIELD composite along the triangle sides, resulting in 5 SPECTRA ® SHIELD composite layers on one side and 6 SPECTRA ® SHIELD composite layers on the other side. Areal density of the SPECTRA ® SHIELD composite on the impact side is 0.66 kg/m$^2$ and on the remote side was 0.792 kg/m$^2$. (Wrapping procedures are shown in FIG. 6). Forty wrapped triangle, arranged in an area filling pattern, were placed between release film and between top and bottom layers of silicone rubber pad (0.125 in., (0.318 cm) thick. The triangles Were molded at 120° C. for 30 minutes using a hydraulic force 10 ton (9080 kg).

The hexagons were wrapped in a similar manner using rectangular SPECTRA ® SHIELD composite strips as shown in FIG.7, yielding an areal density of 0.792 kg/m$^2$ on both the impact and remote surfaces and with all hexagon edges covered with SPECTRA SHIELD composite.

The target exhibited flexibility appropriate for use in body armor and similar to that of the CONTROL target.

EXAMPLE 2

Testing of Armor Target W-1

This armor was tested in an identical manner to that of the CONTROL armor. All five drops against the hexagon on the impact side and all five drops against the triangles most remote from the impact were defeated. Examination of the target after disassembly showed that when the ice-picks impacted the wrapped triangles they were bent and the tips emerged from the SPECTRA ® SHIELD composite after hooking approximately 1 to 2 cm width of the SPECTRA ® SHIELD composite. This interaction makes it nearly impossible for the ice-pick to slide to the edge of the metal plate.

COMPARISON EXAMPLE 3

Comparison of Laminated and Wrapped Titanium Triangles

A series of titanium triangles, identical to those used in preparation of the control target were wrapped in a SPECTRA ®SHIELD composite strip as shown in FIG. 7. The wrapped triangles were molded in a similar manner to the triangles used in the W-1 target. A C-clamp was used to secure the triangles to a table top and the triangles were struck a number of times from different angles with ice-picks. The ice-pick points were caught by the SPECTRA ® SHIELD composite wrapping and prevented from moving across the face of the titanium plate. The same tests were carried out against triangles which were identical to the wrapped triangles except the SPECTRA ® SHIELD was cut around the perimeter of the titanium triangles, resulting in the SPECTRA ® SHIELD being merely laminated to the face of the titanium triangles. When these triangles were struck with the ice-picks at various angles the SPECTRA ® SHIELD was dislodged from the titanium plate and the ice-pick points easily slid off the edge of the titanium triangle. Similarly, when ice-picks struck the unmodified titanium plate the points easily slid off the edge of the triangle.

WHAT IS CLAIMED IS:

1. A penetration resistant composite comprising a planar body having one or more fibrous layers on a surface of said body, each of said layers comprising a fiber network, said fiber network such that movement of said fibers in the direction of the edges of said body is restrained such that when said composite is tested with a high L/D threat in accordance with The State of California Specification 8470-8BS-001, Paragraph 3.3, dated Aug. 1988, the movement of the point of said threat along the surface of said composite is restrained by said fiber network.

2. A composite as recited in claim 1 wherein the weight percent of said planar body is from about 10 to about 95 and the weight percent of said fibrous layer is from about 90 to about 5 based on the total of said composite.

3. A composite as recited in claim 2 wherein the weight percent of said planar body is from about 30 to about 90 and the weight percent of said fibrous layer is from about 70 to about 10.

4. A composite as recited in claim 3 wherein the weight percent of said planar body is from about 60 about 90 and the weight percent of said fibrous layer is from about 40 to about 10.

5. A composite as recited in claim 4 wherein the weight percent of said planar body is from about 70 to about 90 and the weight percent of said fibrous layer is from about 30 to about 10.

6. A composite as recited in claim 5 wherein said body is a polygonal body, and said fibrous layer comprises a fibrous girdle encircling said body such that substantially all of each surface and edge of said body is covered by said fibrous girdle.

7. A composite as recited in claim 6 wherein said fibrous layer comprises a network of high strength fibers having a tensile strength of at least about 5 grams/denier, a tensile modulus of at least about 30 grams/denier and an energy-to-break of at least about 15 joules/gram.

8. A composite as recited in claim 7 wherein said tenacity is equal to or greater than about 10 g/d, said modulus is equal to or greater than about 500 g/d, and said energy-to-break is equal to or greater than about 20 j/g.

9. A composite as recited in claim 8 wherein said tenacity is equal to or greater than about 20 g/d, said modulus is equal to or greater than about 1000 g/d, and said energy-to-break is equal to or greater than about 30 j/g.

10. A composite as recited in claim 7 wherein said fibers are polyethylene fibers, aramid fibers, metal fibers, polyester fibers, nylon fibers, glass fibers or mixtures thereof.

11. A composite as recited in claim 10 wherein said fibers are polyethylene fibers.

12. A composite as recited in claim 10 wherein said fibers are aramid fibers.

13. A composite as recited in claim 10 wherein said fibers are a mixture of at least two of polyethylene fibers, nylon fibers, aramid fibers and glass fibers.

14. A composite as recited in claim 7 wherein said fibrous girdle if formed from at least one sheet-like uniaxial fibrous layer in which said fibers are arranged substantially parallel to one another along a common fiber direction.

15. A composite as recited in claim 14 wherein said fibrous layer comprises more than one uniaxial fibrous layer with adjacent arrays aligned at an angle with respect to the longitudinal axis of the parallel fibers contained in said adjacent uniaxial layer, and wherein each edge has at least one layer of restrained fibers wherein all or a portion of said restrained fibers are parallel to or substantially parallel to said edge.

16. A composite as recited in claim 15 wherein at least one of said uniaxial layers is wrapped about all or substantially all of the planar surfaces and edges of said body in a continuous or substantially continuous fashion.

17. A composite as recited in claim 15 wherein said uniaxial layers are dispersed in a polymeric matrix.

18. A composite as recited in claim 15 wherein said angle is from about 45° to about 90°.

19. A composite as recited in claim 18 wherein said angle is about 90°.

20. A composite as recited in claim 7 wherein said substrate layer comprises a non-woven fabric, a woven fabric or a combination thereof wherein each edge has at least one layer of restrained fibers wherein all or a portion of said restrained fibers are parallel to or substantially parallel to said edge.

21. A article of manufacture comprising a body formed totally or in part from the composite of claim 1.

22. An improved penetration resistant composite of the type comprising at least one substrate layer having one or more planar elements affixed to a surface thereof, the improvement comprising at least one penetration resistant layer comprising a flexible substrate having a plurality of penetration resistant elements on a surface thereof, said elements comprising a planar body having one or more fibrous layers on a surface of said body, each of said layers comprising a fiber network, said fiber network such that movement of said fibers in the direction of the edges of said body is restrained such that when said composite is tested with a high L/D threat in accordance with The State of California Specification 8470-8BS-001,Paragraph 3.3, dated Aug. 1988, the movement of the point of said threat along the surface of said element is restrained by said fiber network.

23. A article of manufacture comprising a body formed totally or in part from the composite of claim 21.

24. A article of claim 23 which is a body armor.

* * * * *